US008083545B2

(12) United States Patent
Koitabashi et al.

(10) Patent No.: US 8,083,545 B2
(45) Date of Patent: Dec. 27, 2011

(54) SHIELD STRUCTURAL BODY, CONNECTOR ASSEMBLY AND CONNECTOR STRUCTURAL BODY HAVING SHIELD STRUCTURAL BODY, CASING ASSEMBLY, AND ELECTRIC COMPRESSOR

(75) Inventors: Takatoshi Koitabashi, Takasaki (JP); Masahiko Osaka, Ohta (JP); Hideo Ikeda, Isesaki (JP)

(73) Assignee: Sanden Corporation, Isesaki-shi, Gunma (JP)

( * ) Notice: Subject to any disclaimer, the term of this patent is extended or adjusted under 35 U.S.C. 154(b) by 281 days.

(21) Appl. No.: 12/307,911

(22) PCT Filed: Jun. 20, 2007

(86) PCT No.: PCT/JP2007/062382

§ 371 (c)(1),
(2), (4) Date: Jan. 7, 2009

(87) PCT Pub. No.: WO2008/004442

PCT Pub. Date: Jan. 10, 2008

(65) Prior Publication Data

US 2009/0321128 A1 Dec. 31, 2009

(30) Foreign Application Priority Data

Jul. 7, 2006 (JP) ..... 2006-187627

(51) Int. Cl.
*H01R 13/648* (2006.01)

(52) U.S. Cl. ..... 439/607.01

(58) Field of Classification Search ..... 439/607.01, 439/607.41, 607.54, 607.55, 88, 607.59, 439/271; 174/359, 350

See application file for complete search history.

(56) References Cited

U.S. PATENT DOCUMENTS

| | | | | |
|---|---|---|---|---|
| 5,222,909 | A * | 6/1993 | Nomura et al. | 439/607.01 |
| 6,010,348 | A * | 1/2000 | Alden | 439/274 |
| 6,283,793 | B1 * | 9/2001 | Nakata | 439/607.48 |
| 7,344,413 | B2 * | 3/2008 | Nishida | 439/607.41 |

* cited by examiner

*Primary Examiner* — Edwin A. Leon
(74) *Attorney, Agent, or Firm* — Baker Botts L.L.P.

(57) ABSTRACT

Disclosed are a shield structural body, a connector assembly and connector structural body using the shield structural body, a casing assembly having the connector assembly, and an electric compressor having the casing assembly. The shield structural body is formed of an electrically conductive material and has a tube section, a ground electrode terminal formed electrically integrally with the tube section, claw sections integrally formed with the tube section, projected at least either radially outward or inward from the tube section, and engageable with a shield structural body holding member. The shield structural body can be produced at low cost, the connector assembly can provide high productivity and can be produced at low cost, the connector structural body is highly reliable, the casing assembly using the connector assembly is highly versatile, and the electric compressor having the casing assembly can easily cope with model changes.

17 Claims, 4 Drawing Sheets

SHIELD STRUCTURAL BODY, CONNECTOR ASSEMBLY AND CONNECTOR STRUCTURAL BODY HAVING SHIELD STRUCTURAL BODY, CASING ASSEMBLY, AND ELECTRIC COMPRESSOR

CROSS-REFERENCE TO RELATED APPLICATIONS

This application is the National Stage of International Patent Application No. PCT/JP2007/062382, filed Jun. 20, 2007, which claims the benefit of Japanese Patent Application No. 2006-187627, filed Jul. 7, 2006, the disclosures of which are incorporated herein by reference in their entirety.

TECHNICAL FIELD OF THE INVENTION

The present invention relates to a connector related structure which is used for vehicles, etc., and specifically, to a shield structural body for a connector, a connector assembly and a connector structural body having the shield structural body, a casing assembly using the connector assembly, and an electric compressor provided with the casing assembly, which are suitable for an electric compressor in an air conditioning system for vehicles, etc.

BACKGROUND ART OF THE INVENTION

Various structures are proposed as a connector used for an electric compressor, etc., for an air conditioning system for vehicles, etc. Patent document 1, for example, discloses an assembling-type shield connector comprising a tubular outer housing made of an insulating resin, a tubular metal shell which is inserted into the outer housing and fixed therein by engaging means, an inner housing made of an insulating resin which is inserted into the metal shell to be fixed by engaging means, a shield cable connected with a terminal which is contained in the inner housing, a rear shell which is fitted to be engaged with a rear section of the metal shell by engaging means to seal the rear opening of the metal shell, an annular cap made of an insulating resin which nips a contact section with a shield section of the shield cable inserted into the semi-annular opposing contact sections elongated at the rear sections of the metal shell and the rear shell, a rear cover made of a synthetic resin which is fitted into and engaged with a rear end section of the outer housing by engaging means and which delivers out the shield cable.

Further, Patent document 2 discloses an inverter integrated electric compressor for vehicles comprising a compressor section being a part of a refrigerating cycle device a motor section which is connected integrally with the compressor section to drive the compressor section, a housing which contains the compressor section and the motor section, and an inverter circuit section which has predetermined number of electric power switching elements and transforms a direct current power to a three-phase alternating current power to supply the electric power to the motor section, and the compressor performing cooling by using low-pressure refrigerant gas, characterized in that each electric power switching element is composed separately of a discrete transistor having a side surface on which an electrode terminal is projected and a bottom surface which is contacted directly to an outer circumferential surface of a peripheral wall of a part of the housing surrounding the motor section.

Patent document 1: Japanese Utility Model Laid-Open 5-25678

Patent document 2: JP-A-2003-322082

DISCLOSURE OF THE INVENTION

Problems to be Solved by the Invention

In the structure disclosed in the above-described Patent document 1, however, the electric connection between the shield structural body and the shield cable braid is performed by pushing contact where a pushing force is obtained by engagement by pushing the end cap onto the outer housing. However, the end cap and the outer housing are formed of insulating resin materials and such resin materials are inevitable to deteriorate by long-term use or temperature environment. Further, it is likely to use vehicles for more than 5 to 10 years and especially the environment in an engine room is very severe for resin materials because of exhausted heat from the engine and vibration. Furthermore, because an electric compressor used in a refrigeration cycle of an air conditioning system for vehicles is installed closely to an engine, the environment around it is further severer. Therefore, progression of the aged deterioration may accelerate a reduction of the pushing force and may damage reliability of the electrical connection between the shield structural bodies. Further, there is also a problem that, because shield structural bodies for shielding a main electrode are provided to both of a male side connector and a female side connector, such a structure is expensive.

Further, in the structure disclosed in the above-described Patent document 2, because a male connector is formed integrally with a resin casing made of resin which contains a control circuit, the direction of the male connector is to be determined depending upon the casing. However, positions or directions for installing an electric compressor vary depending on manufacturers and vehicles. In case where a position or a direction for a male connector to be installed is changed in accordance with a vehicle, the arrangement of a housing, a casing, control parts, etc. must be changed. Therefore, the change may spread not only to a change of individual part level but also to a change of assembly process level and therefore, it would become a great change.

Accordingly, an object of the present invention is to provide a shield structural body which can be manufactured at a low cost, a connector assembly which has a high productivity and can be manufactured at a low cost, a connector structural body which has a high reliability, a casing assembly using them which has a high versatility, and an electric compressor having these and being easy to cope with change in models.

Means for Solving the Problems

To achieve the above-described object, a shield structural body according to the present invention is a shield structural body, which is formed of an electrically conductive material, and which has a tube section, a ground electrode terminal formed electrically integrally with the tube section, a plurality of claw sections which are formed integrally with the tube section and projected at least either radially outward or inward from the tube section, and engageable with a shield structural body holding member. In such a body by the structure wherein the functions (shielding, connecting and engaging) required as a shield structural body are given integrally, the cost can be reduced by decrease of the number of parts.

This shield structural body may be formed after parts corresponding to the tube section, the ground electrode terminal and the claw sections are punched out integrally by pressing. By such a structure, the shield structural body can be manufactured more easily, and the cost can be reduced by more decrease of the number of parts.

Further, it may be formed after parts corresponding to the tube section and claw sections are punched out integrally by pressing, and the ground electrode terminal may be formed integrally by caulking or welding. By such a structure, the cost can be reduced by decrease of the number of parts, and because it can be formed as an approximate rectangular pressed part comprising the tube section and the claw sections by forming the ground electrode terminal separately, the yield can be increased.

The present invention also provides a connector assembly A comprising a shield structural body as described above.

To be more practical embodiment, a connector assembly A having a shield structural body according to the present invention is a connector assembly A having a shield structural body, comprising:

a connector which comprises an outer housing, an inner housing having an insertion hole for a ground electrode terminal and a main electrode, a deep groove portion formed between the outer housing and the inner housing and a flange portion formed integrally with the outer housing; and a shield structural body, which is formed of an electrically conductive material, which has a tube section, a ground electrode terminal formed electrically integrally with the tube section and a plurality of claw sections which are formed integrally with the tube section and projected at least either radially outward or inward from the tube section, and which is inserted into the deep grove portion, wherein the ground electrode terminal is inserted into the insertion hole, and the claw sections of the shield structural body are engaged with at least either an outer housing-side surface of the deep groove portion or an inner housing-side surface of the deep groove portion (embodiment 1 of a connector assembly A). In this structure, because the functions (shielding, connecting and engaging) required as a shield structural body are given integrally, the cost can be reduced by decrease of the number of parts, and because the claw sections are to be engaged with at least either the outer housing-side surface of the deep grove portion or the inner housing-side surface of the deep grove portion as well as an insertion of the shield structural body into the deep groove portion, another engaging means is not required, and the inserting operation and the engaging operation can be merged in assembling, therefore the assembly efficiency can be improved.

Further, a connector assembly A having a shield structural body according to the present invention is a connector assembly A having a shield structural body comprising:

a connector which comprises an outer housing, an inner housing having an insertion hole for a ground electrode terminal and a main electrode, a deep groove portion formed between said outer housing and said inner housing and a flange portion formed integrally with sad outer housing; and a shield structural body, which is formed of an electrically conductive material, which has a tube section, a ground electrode terminal formed electrically integrally with the tube section and a plurality of claw sections which is formed integrally with the tube section and projected radially outward from the tube section, and which is inserted into the deep groove portion, wherein the ground electrode terminal is inserted into the insertion hole, and the claw sections of the shield structural body are nipped by a structural body (e.g. casing as described below) fixing the outer housing and an end surface of the flange portion of the outer housing (embodiment 2 of a connector assembly A). In this structure, because the functions (shielding, connecting and engaging) required as a shield structural body are given integrally, the cost can be reduced by decrease of the number of parts, and because the claw sections formed integrally with the shield structural body are to be inflected along the end surface of the flange portion and are to be nipped by the structural body fixing the housing and the end surface of the flange portion, therefore another engaging means is not required. Thus, the operation fixing the housing with the structural body and the operation fixing the shield structural body can be merged in assembling, therefore the assembly efficiency can be improved.

Further, a connector assembly A having a shield structural body according to the present invention is a connector assembly A having a shield structural body, comprising:

a connector which comprises an outer housing, an inner housing having an insertion hole for a ground electrode terminal and a main electrode, a deep groove portion formed between the outer housing and the inner housing and a flange portion formed integrally with the outer housing; and a shield structural body, which is formed of an electrically material, which has a tube section, a ground electrode terminal formed electrically integrally with the tube section and a plurality of claw sections which is formed integrally with the tube section and projected radially outward from the tube section, and which is inserted into the deep groove portion, wherein the ground electrode terminal is inserted into the insertion hole, and the claw sections of the shield structural body are pushed into a tapered inner circumferential surface of a hole formed in a structural body fixing the outer housing and are engaged with the inner circumferential surface of the hole (embodiment 3 of a connector assembly A). In this structure, because the functions (shielding, connecting and engaging) required as a shield structural body are given integrally, the cost can be reduced by decrease of the number of parts, and because, when the claw sections formed integrally with the shield structural body are pushed into the hole of the outer housing, they are pushed into the tapered inner circumferential surface to be engaged with the circumferential surface of the hole, therefore another engaging means is not required. Thus, the operation fixing the housing with the structural body and the operation fixing the shield structural body can be merged in assembling, therefore the assembly efficiency can be improved.

The present invention also provides a connector structural body comprising:

a connector assembly A as described above; and a connector assembly B comprising a shield cable being introduced, a terminal for connection to a main electrode provided on an end portion of the shield cable, a terminal for connection to a ground electrode provided on the end portion of the shield cable and fixed to a shield braid by caulking, a main housing provided with an insertion hole for each terminal, an end cap sealing an opening end section of the main housing and delivering out the shield cable, a cable seal which is nipped by the main housing and the end cap and seals watertightly an inner circumferential surface of the end cap and a periphery of the shield cable while delivering out the shield cable, and a housing seal which is contained in the main housing and seals watertightly an inner housing of a male side connector of the connector assembly A and the main housing, wherein the connector assembly B is fitted and engaged with the connector assembly A having a shield structural body to be connected mechanically and electrically. In this connector structural body, as compared to the conventional structure where the shield structural bodies shielding main electrode are provided in both the male side connector and the female side connector and the electrical connection of the shield structural body and the braid of the shield cable is made by pressing, the structure of providing the shield structural body only to the male side connector (only to the connector assembly A) can decrease the number of parts, and therefore, the cost can be reduced. Further, because the braid of the shield cable and the shield structural body are connected by linking the ground electrode terminal fixed by caulking to the braid of the shield cable and the ground electrode terminal formed integrally with the shield structural body, they can be strongly connected electrically and mechanically, therefore a connector structure with a high reliability can be realized.

The present invention also provides a casing assembly comprising a connector assembly A (the above-described embodiment 1) as described above, a casing which has an opening hole and provided with a control circuit therein and a main electrode of which one end is connected to the control circuit and the other end is delivered out from the opening hole, wherein the main electrode is inserted into an insertion hole provided in the inner housing to be engaged with it, and the casing and the flange portion of the outer hosing are fixed to each other. In such a casing assembly, because the functions (shielding, connecting and engaging) required as a shield structural body are given integrally, the cost can be reduced by decrease of the number of parts. At the same time, because the claw sections are engaged with at least either the outer housing-side surface of the deep groove portion or the inner housing-side surface of the deep groove portion as well as an insertion of the shield structural body into the deep groove portion, another engaging means is not required, and the inserting operation and the engaging operation can be merged in assembling, therefore the assembly efficiency can be improved. Furthermore, because the flange portion of the outer housing is fixed to the opening hole portion provided on the side surface of the casing, the mounting location and the mounting direction of the connector assembly depend only on the casing. Therefore, if the hole portion location of the casing is selected in accordance with the mounting location and the mounting direction of the connector assembly which vary depending on vehicles, the casing assembly where the other parts are unaffected in assembling can be realized.

The present invention also provides a casing assembly comprising a connector assembly A (the above-described embodiment 2), a casing which has an opening hole and provided with a control circuit therein and a main electrode of which one end is connected to the control circuit and the other end is delivered out from the opening hole, wherein the main electrode is inserted into an insertion hole provided in the inner housing to be engaged with it, and the casing and the flange portion of the outer housing are fixed to each other while the claw sections of the shield structural body are nipped by a casing as an outer housing fixing structural body and an end surface of the flange portion of the outer housing. In such a casing assembly, because the functions (shielding, connecting and engaging) required as a shield structural body are given integrally, the cost can be reduced by decrease of the number of parts. Further, because the claw sections formed integrally with the shield structural body are to be inflected along the end surface of the flange portion and are to be nipped by the structural body fixing the housing and the end surface of the flange portion, therefore another engaging means is not required. Thus, the operation fixing the outer housing with the structural body (casing) and the operation fixing the shield structural body can be merged in assembling, therefore the assembly efficiency can be improved. Furthermore, because the flange portion of the outer housing is fixed to the opening hole portion provided on the side surface of the casing, the mounting location and the mounting direction of the connector assembly depend only on the casing. Therefore, if the hole portion location of the casing is selected in accordance with the mounting location and the mounting direction of the connector assembly which vary depending on vehicles, the casing assembly where the other parts are unaffected in assembling can be realized.

The present invention also provides a casing assembly comprising a connector assembly A (The above-described embodiment 3), a casing which has an opening hole and provided with a control circuit therein and a main electrode of which one end is connected to the control circuit and the other end is delivered out from the opening hole, wherein the main electrode is inserted into an insertion hole provided in the inner housing to be engaged with it, and the casing and the flange portion of the outer hosing are fixed to each other while the claw sections of the shield structural body are pushed into a tapered inner circumferential surface of the opening hole portion to be engaged with the inner circumferential surface. In such a casing assembly, because the functions (shielding, connecting and engaging) required as a shield structural body are given integrally, the cost can be reduced by decrease of the number of parts. Further, because the claw sections formed integrally with the shield structural body are pushed into the tapered inner circumferential surface of the opening hole portion to be engaged with the inner circumferential surface when the outer housing is assembled with the casing, another engaging means is not required. Thus, the operation fixing the outer housing with the structural body (casing) and the operation fixing the shield structural body can be merged in assembling, therefore the assembly efficiency can be improved. Furthermore, because the flange portion of the outer housing is fixed to the opening hole portion provided on the side surface of the casing, the mounting location and the mounting direction of the connector assembly depend only on the casing. Therefore, if the hole portion location of the casing is selected in accordance with the mounting location and the mounting direction of the connector assembly which vary depending on vehicles, the casing assembly where the other parts are unaffected in assembling can be realized.

In the casing assembly as described above, it is preferred that the tube section of the shield structural body is larger than the opening hole of the casing. Because when the tube section of the shield structural body is larger than the opening section of the casing, the shield structural body is to be surrounded by the deep groove portion and the side surface of the casing, therefore even if the engagement of the shield structural body is broken by a damage of the claw section, the shield structural body cannot be disengaged from the connector assembly to be fallen out. Thus, a casing assembly with a high reliability can be realized.

In such a casing assembly, it is preferred that the casing is formed of an electrically conductive material and at least either the tube section of the shield structural body or the claw section comes into contact with the casing. If the casing is made of an electrically conductive material and at least either the tube section of the shield structural body or the claw section comes into contact with the casing, because the casing is to be connected electrically to the shield structural body, additional grounding means are not to be required and the assembly efficiency thereof can be improved.

The present invention also provides an electric compressor comprising a closed container body, an electric element and compressing element provided inside the closed container body, and a casing assembly as described above provided outside the closed container body, the casing assembly having therein a control circuit for controlling the electric element. By this, an electric compressor which can produce effects in the shield structural body, the connector assembly, the connector structural body and the casing assembly as described above in combination can be realized.

In such an electrical compressor, it is preferred that a high voltage connector assembly as a power source for operating the electric element and a low voltage connector assembly as a power source for operating the control circuit are provided in an identical side surface of the casing assembly. In such a structure, because, for example, a space required for the interconnection of the electrical compressor mounted in an engine room can be restricted in a single direction of the mounting direction of the connector assembly, the space required for mounting can be narrowed, and the mounting efficiency can be improved.

EFFECT ACCORDING TO THE INVENTION

Thus, in the shield structural body according to the present invention, because the functions (shielding, connecting and engaging) required as a shield structural body are given integrally, the cost can be reduced by decrease of the number of parts.

Further, in the connector assembly according to the present invention, in addition to the effect by the above-described shield structural body, the inserting operation and the engaging operation of the shield structural body can be merged in assembling, and the assembly efficiency can be improved.

Further, in the connector structural body according to the present invention, the shield structural body can be provided only in the male side connector (only in the connector assembly A), so that the cost can be reduced by decrease of the number of parts, and the connectors can be strongly connected electrically and mechanically each other to realize a connector structure with a high reliability.

Further, in the casing assembly according to the present invention, because the operation fixing the outer housing with the structural body (casing) and the operation fixing the shield structural body can be merged in assembling, the assembly efficiency can be improved. Furthermore, because the flange portion of the outer housing is fixed to the opening hole portion provided on the side surface of the casing, the mounting location and the mounting direction of the connector assembly depend only on the casing, so that if the hole location of the casing is selected in accordance with the mounting location and the mounting direction of the connector assembly which vary depending on vehicles, the casing assembly where the other parts are unaffected in assembling can be realized.

Further, in the electric compressor according to the present invention, it can be realized that effects in the shield structural body, the connector assembly, the connector structural body and the casing assembly as described above are produced in combination, therefore the assembly efficiency and productivity of the electric compressor can be improved and the cost thereof can be reduced.

EXPLANATION OF SYMBOLS

Figure 1:
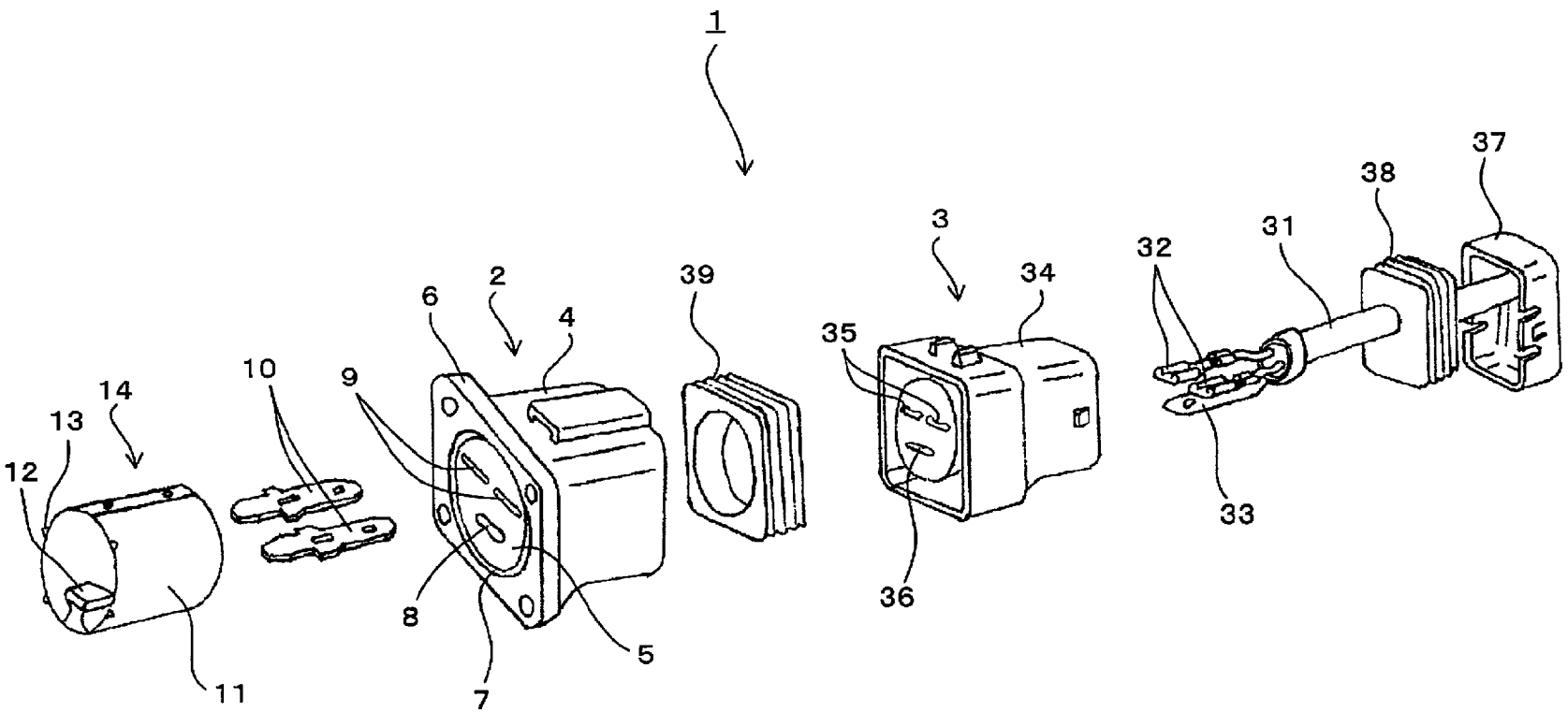
FIG. 1 is an exploded perspective view of a connector structural body according to an embodiment of the present invention.

1: connector structural body
2: male connector as connector assembly A
3: female connector as connector assembly B
4: outer housing
5: inner housing
6: flange portion
7: deep groove portion
8: insertion hole for ground electrode terminal
9: insertion hole for main electrode
10: main electrode
11: tube section
12, 12*a*: ground electrode terminal
13, 13*a*, 13*b*: claw section
14, 14*a*, 14*b*, 14*c*: shield structural body
15, 15*a*: plate-like material
21: structural body
22: hole
23: tapered inner circumferential surface of hole
31: shield cable
32: female terminal for connecting to main electrode
33: male terminal for connecting to ground electrode
34: main housing
35,36: insertion hole
37: end cap
38: cable seal
39: housing seal
40: phenol resin
41: electric compressor
42: casing
43: casing assembly
44: closed container body
45: high voltage side connector assembly
46: low voltage side connector assembly

THE BEST MODE FOR CARRYING OUT THE INVENTION

Hereinafter, desirable embodiments of the present invention will be explained referring to figures.

FIG. 1 shows a connector structural body according to the present invention. The connector structural body contains a shield structural body according to the present invention and a connector assembly A according to the present invention. In FIG. 1, 1 means a whole connector structural body, and connector structural body 1 comprises male connector 2 as a connector assembly A according to an embodiment of the present invention and female connector 3 assembly B as a connector assembly B in the present invention which is fitted with male connector 2. Male connector 2 and female connector 3 are, for example, made of such resins as PBT (polybutylene terephthalate), etc. Male connector 2 comprises outer housing 4, inner housing 5 and flange portion 6 formed integrally with outer housing 4. Between outer housing 4 and inner housing 5 is formed deep groove portion 7. Further, in inner housing 5 are formed insertion hole 8 for a ground electrode terminal and insertion hole 9 for a main electrode, and main electrode 10 is provided in insertion hole 9. The structure of main electrode 10 is not only a terminal structure as depicted in the figure but any structure with a connecting element.

Into deep groove portion 7 of male connector 2 is inserted shield structural body 14 made of an electrically conductive material which comprises tube section 11, ground electrode terminal 12 formed electrically integrally with the tube section, a plurality of claw sections 13 which are formed integrally with tube section 11 and projected at least either radially outward or inward (radially outward in the depicted example), and engageable with a shield structural body holding member (such as outer housing 4 and/or inner housing 5 of male connector 2, or an end surface of outer housing 4 and a casing as described later, or a inner circumferential surface of an opening hole formed in a casing as described later). Ground electrode terminal 12 is inserted into insertion hole 8, and claw sections 13 are engaged with at least either an outer housing-side surface of a deep groove portion or an inner housing-side surface of a deep groove portion (with an outer housing-side surface of a deep groove portion). Shield structural body 14, especially tube section thereof, is made of an electrically conductive material, such as a nickel-plated or tinned brass.

Figure 2:
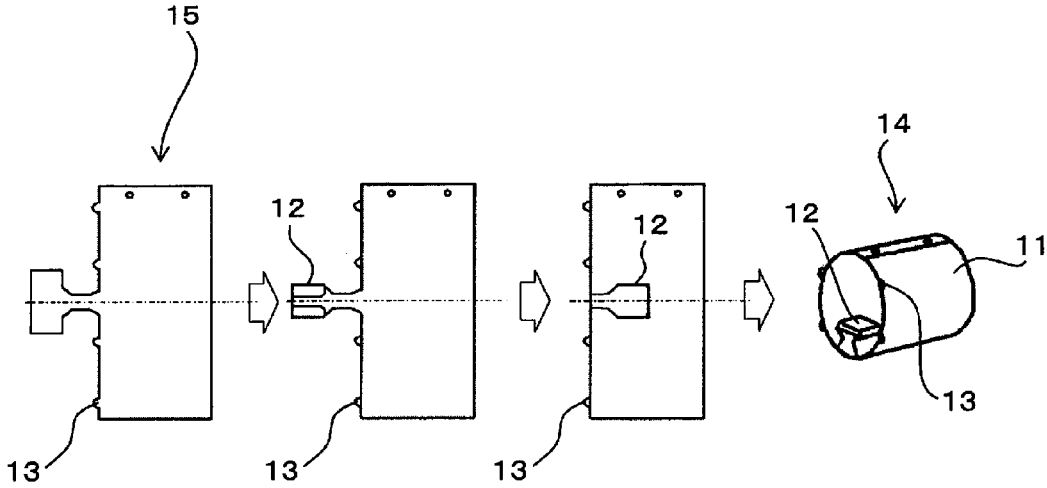
FIG. 2 is a process flow diagram showing an example of a manufacture process of a shield structural body according to an embodiment of the present invention.
Figure 3:
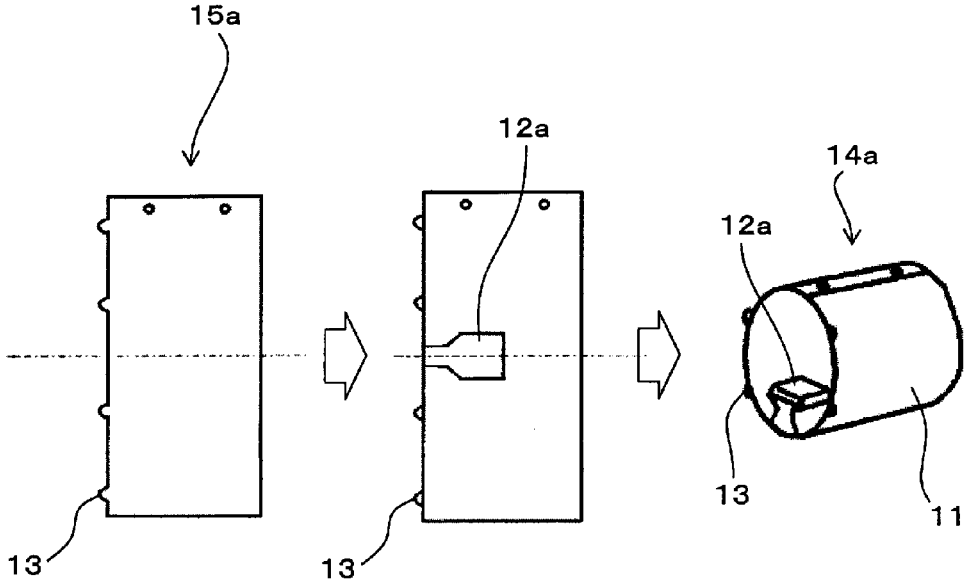
FIG. 3 is a process flow diagram showing another example of a manufacture process of a shield structural body according to an embodiment of the present invention.

In shield structural body 14, as depicted in FIG. 2 for example, after parts corresponding to tube section 11, ground electrode terminal 12 and claw sections 13 may be punched out integrally by pressing to plate-like material, ground electrode terminal 12 may be formed in a predetermined connectable shape, and ground electrode terminal 12 may be bended toward a predetermined direction and then, parts corresponding to the tube section may be rounded to form tube section 11, so that tube section 11, ground electrode terminal 12 and claw sections 13 can be integrated to form shield structural body 14. Alternatively, as depicted in FIG. 3 for example, after parts corresponding to tube section 11 and claw sections 13 may be punched out integrally by pressing to plate-like material, ground electrode terminal 12*a* may be formed integrally by caulking or welding (by welding in the depicted example) so that tube section 11, ground electrode terminal 12*a* and claw sections 13 can be integrated to form shield structural body 14.

In such a shield structural body 14, 14*a*, because tube section 11, ground electrode terminal 12, 12*a*, and claw sections 13 are integrated, the functions (shielding, connecting and engaging) as a shield structural body are given integrally, therefore the cost can be reduced by decrease of the number of parts. Further, in male connector 2 as a connector assembly A comprising such a shield structural body 14, 14*a*, in addition, because claw sections 13 are engaged with at least either the outer housing-side surface of the deep groove portion or the inner housing-side surface of the deep groove portion, as well as an insertion of shield structural body 14, 14*a* into deep groove portion 7, another engaging means is not required, and the inserting operation and the engaging operation can be merged in assembling, therefore the assembly efficiency can be improved.

Figure 4:
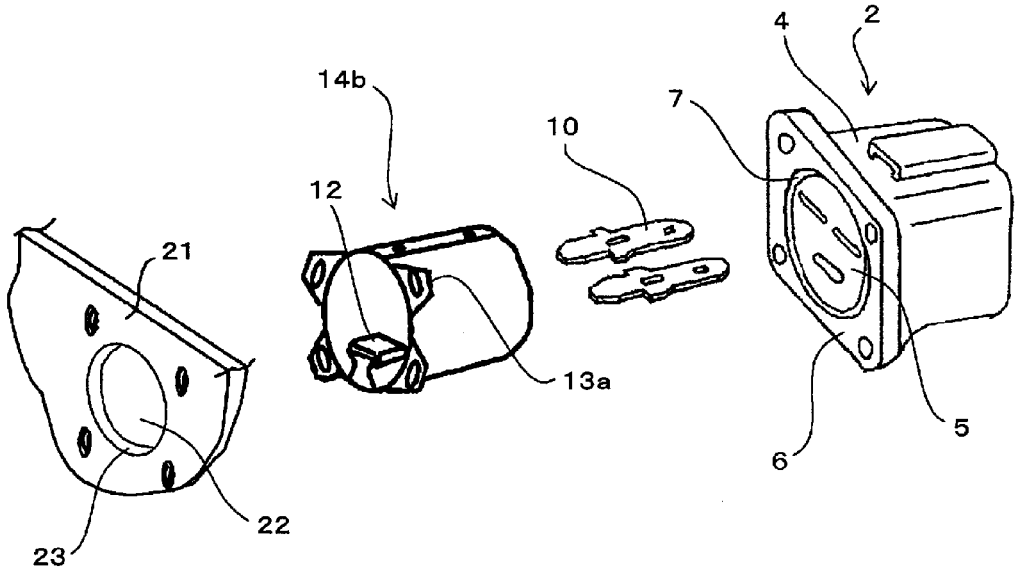
FIG. 4 is an exploded perspective view of a connector assembly A according to an embodiment of the present invention.

The engaging or holding structure of the shield structural body may be the structure where it is engaged in deep groove portion 7 as described above, or the structure as depicted in FIG. 4 for example, where claw sections 13*a* of shield structural body 14*b* are nipped by structural body 21 (for example, a casing described later, especially a metal casing) fixing outer housing 4 and an end surface of flange portion 6 of outer housing 4. Also in such a case, another engaging means is not required, and the operation fixing shield structural body 14*b* and the operation fixing outer housing 4 with structural body 21 can be merged in assembling, therefore the assembly efficiency can be improved.

Figure 5:
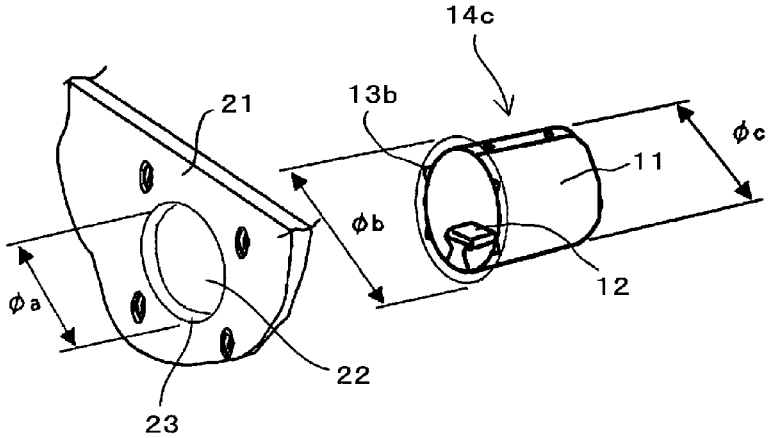
FIG. 5 is a perspective view showing an example of a fixation method of a shield structural body according to an embodiment of the present invention.

Further, the engaging or holding structure of the shield structural body may be the structure as depicted in FIG. 5 for example, where claw sections 13*b* of shield structural body 14*c* are pushed into tapered inner circumferential surface 23 of hole 22 formed in structural body 21 (for example, a casing described later, especially a metal casing) fixing outer housing 4 and are engaged with inner circumferential surface 23 of the hole. Also in such a case, another engaging means is not required, and the operation fixing shield structural body 14*c* and the operation fixing outer housing 4 with structural body 21 can be merged in assembling, therefore the assembly efficiency can be improved. In such a case, because claw sections 13*b* are pushed concentrically along an tapered surface of tapered inner circumferential surface 23 of hole 22 and deformed inward to be engaged, claw sections 13*b* are strongly held, and shield structural body 14*c* is surely grounded to the side of structural body 21. In such a case, it is preferred to satisfy the following relation. [circumscribed circle diameter ϕb of claw sections 13*b*>diameter ϕa of hole 22 in structural body 21>outer diameter ϕc of tube section 11 in shield structural body 14*c*]

Referring again to FIG. 1, connector structural body 1 comprises male connector 2 as a connector assembly A having a shield structure as above-described and female connector 3 as a connector assembly B which is fitted and connected mechanically and electrically with male connector 2. Shield cable 31 (2-pin) is introduced at the side of female connector 3, and at an end section of shield cable 31 are female terminal 32 for connecting to a main electrode and male terminal 33 for connecting a ground electrode terminal which is provided at an end section of shield cable 31 and fixed to a shield braid by caulking. In main housing 34 of female connector 3 are provided insertion hole 35 for inserting female terminal 32 and insertion hole 36 for inserting male terminal 33. To this main housing 34 are provided end cap 37 sealing an opening end section of the housing and delivering out shield cable 31, cable seal 38 made of rubber, etc. which is nipped by main housing 34 and end cap 37 and seals watertightly an inner circumferential surface of end cap 37 and a periphery of shield cable 31 while delivering out shield cable 31 and housing seal 39 made of rubber, etc. which is contained in main housing 34 and seals watertightly inner housing 5 of the side of male connector 2 as a connector assembly A and main housing 34.

Figure 6:
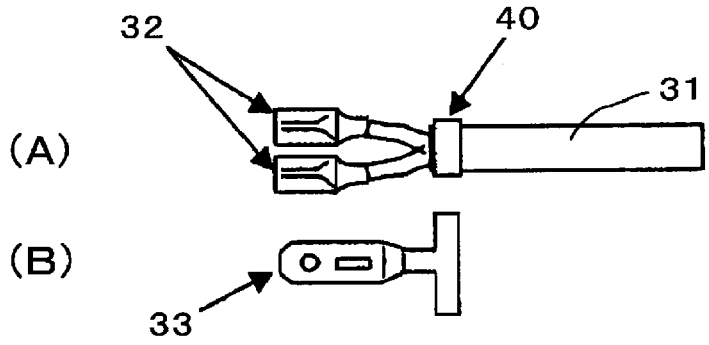
FIG. 6 is a schematic plan view showing an example of a terminal connecting structure in an end section of a shield cable in the present invention.

The connecting structure between female connector 32 and male connector 33 (ground terminal) at an end section of shield cable 31 may be the structure as depicted in FIG. 6 for example, where an end section for pulling out the terminal of shield cable 31 is solidified by resin.

In such connector structural body 1, as compared to the conventional structure, the structure of providing shield structural body 14 only to male connector 2 (only to the connector assembly A) can decrease the number of parts, and therefore, the cost can be reduced. Further, because the braid of shield cable 31 and shield structural body 14 are connected by linking ground electrode terminal 33 fixed by caulking to the braid of shield cable 31 and ground electrode terminal 12 formed integrally with shield structural body 14, they can be strongly connected electrically and mechanically, therefore a connector structure with a high reliability can be realized.

Now, a connector assembly A in connector structural body 1 as described above may be incorporated in a casing assembly. In such a case, if a casing in the casing assembly is regarded as a structural body which fixes an outer housing of a connector assembly A, any connector assembly A of the above-described embodiments 1, 2, 3 can be accepted.

Figure 7:
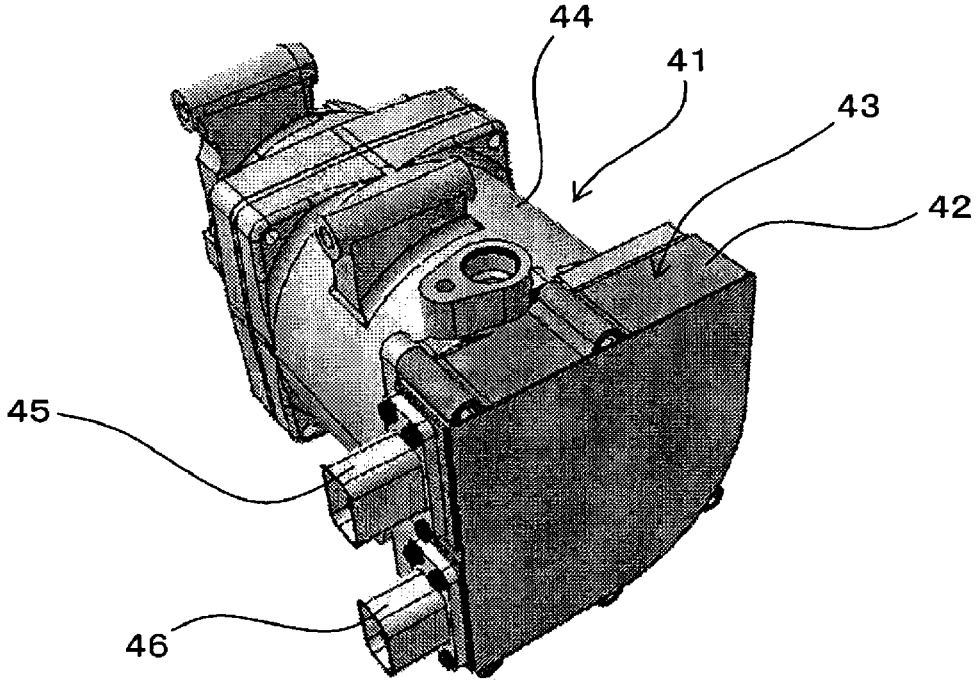
FIG. 7 is a perspective view showing an example of a casing assembly according to an embodiment of the present invention and an electric compressor provided with it.

Showing electric compressor 41 in FIG. 7 as an application of the present invention, a connector assembly A according to the present invention may be mounted with casing 42 of electric compressor 41 to form casing assembly 43 for electric compressor 41. In the depicted example, casing 42 is made of a electrically conductive material, and at least either tube section 11 or claw sections 13 of shield structural body 14 are come into contact with casing 42. Electric compressor 41 comprises closed container body 44, electric element and compressing element (not shown) provided inside closed container body 44 and casing assembly 43 provided outside closed container body 44, casing assembly having therein a control circuit (not shown) for controlling the electric element. In an identical side surface of such a casing assembly 43 are provided high voltage connector assembly 45 formed by connector assembly A as a power source for operating the electric element and low voltage connector assembly 46 formed by connector assembly A as a power source for operating the control circuit. If connector assemblies 45,46 with the targeted shield structure are mounted and provided in an identical side surface of casing assembly 34, because a space required for the interconnection of electric compressor 41 mounted in an engine room, etc. can be restricted in a single direction of the mounting direction of connector assemblies 45, 46 the space required for mounting can be narrowed, and the mounting efficiency can be improved.

INDUSTRIAL APPLICATIONS OF THE INVENTION

The connector-related structure according the present invention can be usually applied to a connector for general devices, and specifically, it is suitable for an electric compressor for an air conditioning system for vehicles, etc.

The invention claimed is:

1. A first connector assembly comprising a shield structural body, which is formed of an electrically conductive material, and which has a tube section, a ground electrode terminal formed integrally within said tube section, a plurality of claw sections which are formed integrally with said tube section and projected at least either radially outward or inward from said tube section, and engageable with a shield structural body holding member, and a second connector assembly comprises a shield cable being introduced, a terminal for connection to a main electrode provided on an end portion of said shield cable, a terminal for connection to a ground electrode provided on said end portion of said shield cable and fixed to a shield braid by caulking, a main housing provided with an insertion hole for each terminal, an end cap sealing an opening end section of said main housing and delivering out said shield cable, a cable seal which is nipped by said main housing and said end cap and seals watertightly an inner circumferential surface of said end cap and a periphery of said shield cable while delivering out said shield cable, and a housing seal which is contained in said main housing and seals watertightly an inner housing of a male side connector as said first connector assembly and said main housing, wherein said second connector assembly is fitted and engaged with said first connector assembly having a shield structural body to be connected mechanically and electrically.

2. The shield structural body according to claim 1, wherein said shield structural body is formed after parts corresponding to said tube section, said ground electrode terminal and said claw sections are punched out integrally by pressing.

3. The shield structural body according to claim 1, wherein said shield structural body is formed after parts corresponding to said tube section and claw sections are punched out integrally by pressing, and said ground electrode terminal is formed integrally by caulking or welding.

4. A casing assembly comprising a first connector assembly having a shield structural body, comprising:

a connector which comprises an outer housing, an inner housing having an insertion hole for a ground electrode terminal and a main electrode, a deep groove portion formed between said outer housing and said inner housing and a flange portion formed integrally with said outer housing;

the shield structural body, which is formed of an electrically conductive material, which has a tube section, a ground electrode terminal formed electrically integrally within said tube section and a plurality of claw sections which are formed integrally with said tube section and projected at least either radially outward or inward from said tube section, and which is inserted into said deep groove portion, wherein said ground electrode terminal is inserted into said insertion hole, and said claw sections of said shield structural body are engaged with at least either an outer housing-side surface of said deep groove portion or an inner housing-side surface of said deep groove portion, and a casing which has an opening hole and provided with a control circuit therein and a main electrode of which one end is connected to said control circuit and the other end is delivered out from said opening hole, wherein said main electrode is inserted into an insertion hole provided in said inner housing to be engaged with it, and said casing and said flange portion of said outer housing are fixed to each other.

5. The casing assembly according to claim 4, wherein said tube section of said shield structural body is larger than said opening hole of said casing.

6. The casing assembly according to claim 5, wherein said casing is formed of an electrically conductive material and at least either said tube section of said shield structural body or said claw section comes into contact with said casing.

7. An electric compressor comprising a closed container body, an electric element and compressing element provided inside said closed container body, and the casing assembly according to claim 4 provided outside said closed container body, said casing assembly having therein a control circuit for controlling said electric element.

8. The electric compressor according to claim 7, wherein a high voltage connector assembly as a power source for operating said electric element and a low voltage connector assembly as a power source for operating said control circuit are provided in an identical side surface of said casing assembly.

9. A casing assembly comprising a first connector assembly having a shield structural body, comprising:

a connector which comprises an outer housing, an inner housing having an insertion hole for a ground electrode terminal and a main electrode, a deep groove portion formed between said outer housing and said inner housing and a flange portion formed with said outer housing;

the shield structural body, which is formed of an electrically conductive material, which has a tube section, a ground electrode terminal formed electrically integrally within said tube section and a plurality of claw sections which is formed integrally with said tube section and projected radially outward from said tube section, and which is inserted into said deep groove portion, wherein said ground electrode terminal is inserted into said insertion hole, and said claw sections of said shield structural body are nipped by a structural body fixing said outer housing and an end surface of said flange portion of said outer housing; and a casing which has an opening hole and provided with a control circuit therein and a main electrode of which one end is connected to said control circuit and the other end is delivered out from said opening hole, wherein said main electrode is inserted into an insertion hole provided in said inner housing to be engaged with it, and said casing and said flange portion of said outer housing are fixed to each other while said claw sections of said shield structural body are nipped by a casing as an outer housing fixing structural body and an end surface of said flange portion of said outer housing.

10. The casing assembly according to claim 9, wherein said tube section of said shield structural body is larger than said opening hole of said casing.

11. An electric compressor comprising a closed container body, an electric element and compressing element provided inside said closed container body, and the casing assembly according to claim 9 provided outside said closed container body, said casing assembly having therein a control circuit for controlling said electric element.

12. A casing assembly comprising a first connector assembly having a shield structural body, comprising:

a connector which comprises an outer housing, an inner housing having an insertion hole for a ground electrode terminal and a main electrode, a deep groove portion formed between said outer housing and said inner housing and a flange portion formed integrally with said outer housing;

a shield structural body, which is formed of an electrically conductive material, which has a tube section, a ground electrode terminal formed electrically integrally within said tube section and a plurality of claw sections which is formed integrally with said tube section and projected radially outward from said tube section, and which is inserted into said deep groove portion, wherein said ground electrode terminal is inserted into said insertion hole, and said claw sections of said shield structural body are pushed into a tapered inner circumferential surface of a hole formed in a structural body fixing said outer housing and are engaged with said inner circumferential surface of said hole; and a casing which has an opening hole and provided with a control circuit therein and a main electrode of which one end is connected to said control circuit and the other end is delivered out from said opening hole, wherein said main electrode is inserted into an insertion hole provided in said inner housing to be engaged with it, and said casing and said flange portion of said outer housing are fixed to each other while said claw sections of said shield structural body are pushed into a tapered inner circumferential surface of said opening hole to be engaged with said inner circumferential surface.

13. The casing assembly according to claim 12, wherein said tube section of said shield structural body is larger than said opening hole of said casing.

14. An electric compressor comprising a closed container body, an electric element and compressing element provided inside said closed container body, and the casing assembly according to claim 12 provided outside said closed container body, said casing assembly having therein a control circuit for controlling said electric element.

15. A connector structural body comprising:

a first connector assembly having a shield structural body, comprising:

a connector which comprises an outer housing, an inner housing having an insertion hole for a ground electrode terminal and a main electrode, a deep groove portion formed between said outer housing and said inner housing and flange portion formed integrally with said outer housing;

the shield structural body, which is formed of an electrically conductive material, which has a tube section, a ground electrode terminal formed electrically integrally within said tube section and a plurality of claw sections which are formed integrally with said tube section and projected at least either radially outward or inward from said tube section, and which is inserted into said deep groove portion, wherein said ground electrode terminal is inserted into said insertion hole, and said claw sections of said shield structural body are engaged with at least either an outer housing-side surface of said deep groove portion or an inner housing-side surface of said deep groove portion; and a second connector assembly comprising a shield cable being introduced, a terminal for connection to a main electrode provided on an end portion of said shield cable, a terminal for connection to a ground electrode provided on said end portion of said shield cable and fixed to a shield braid by caulking, a main housing provided with an insertion hole for each terminal, an end cap sealing an opening end section of said main housing and delivering out said shield cable, a cable seal which is nipped by said main housing and said end cap and seals watertightly an inner circumferential surface of said end cap and a periphery of said shield cable while delivering out said shield cable, and a housing seal which is contained in said main housing and seals watertightly an inner housing of a male side connector as said first connector assembly and said main housing, wherein said second connector assembly is fitted and engaged with said first connector assembly having a shield structural body to be connected mechanically and electrically.

16. A connector structural body comprising:

a first connector assembly having a shield structural body, comprising:

a connector which comprises an outer housing, an inner housing having an insertion hole for a ground electrode terminal and a main electrode, a deep groove portion formed between said outer housing and said inner housing and a flange portion formed integrally with said outer housing;

the shield structural body, which is formed of an electrically conductive material, which has a tube section, a ground electrode terminal formed electrically integrally within said tube section and plurality of claw sections which is formed integrally with said tube section and projected radially outward from said tube section, and which is inserted into said deep groove portion, wherein said ground electrode terminal is inserted into said insertion hole, and said claw sections of said shield structural body are nipped by a structural body fixing said outer housing and an end surface of said flange portion of said outer housing; and a second connector assembly comprising a shield cable being introduced, a terminal for connection to a main electrode provided on an end portion of said shield cable, a terminal for connection to a ground electrode provided on said end portion of said shield cable and fixed to a shield braid by caulking, a main housing provided with an insertion hole for each terminal, an end cap sealing an opening end section of said main housing and delivering out said shield cable, a cable seal which is nipped by said main housing and said end cap and seals watertightly an inner circumferential surface of said end cap and a periphery of said shield cable while delivering out said shield cable, and a housing seal which is contained in said main housing and seals watertightly an inner housing of a male side connector as said first connector assembly and said main housing, wherein said second connector assembly is fitted and engaged with said first connector assembly having a shield structural body to be connected mechanically and electrically.

17. A connector structural body comprising:

a first connector assembly having a shield structural body, comprising:

a connector which comprises an outer housing, an inner housing having an insertion hole for a ground electrode terminal and a main electrode, a deep groove portion formed between said outer housing and said inner housing and a flange portion formed integrally with said outer housing;

a shield structural body, which is formed of an electrically conductive material, which has a tube section, a ground electrode terminal formed electrically integrally within said tube section and a plurality of claw sections which is formed integrally with said tube section and projected radially outward from said tube section, and which is inserted into said deep groove portion, wherein said ground electrode terminal is inserted into said insertion hole, and said claw sections of said shield structural body are pushed into a tapered inner circumferential surface of a hole formed in a structural body fixing said outer housing and are engaged with said inner circumferential surface of said hole; and a second connector assembly comprising a shield cable being introduced, a terminal for connection to a main electrode provided on an end portion of said shield cable, a terminal for connection to a ground electrode provided on said end portion of said shield cable and fixed to a shield braid by caulking, a main housing provided with an insertion hole for each terminal, an end cap sealing an opening end section of said main housing and delivering out said shield cable, a cable seal which is nipped by said main housing and said end cap and seals watertightly an inner circumferential surface of said end cap and a periphery of said shield cable while delivering out said shield cable, and a housing seal which is contained in said main housing and seals watertightly an inner housing of a male side connector as said first connector assembly and said main housing, wherein said second connector assembly is fitted and engaged with said first connector assembly having a shield structural body to be connected mechanically and electrically.

* * * * *